US005638714A

United States Patent [19]

Ryan et al.

[11] Patent Number: 5,638,714

[45] Date of Patent: Jun. 17, 1997

[54] PROCESS FOR MAKING A STRIP FROM A ROD

[75] Inventors: Jerry E. Ryan, Tulsa; James C. McReynolds, Sapulpa; Thomas J. Butchko, Tulsa, all of Okla.

[73] Assignee: Fintube Limited Partnership, Tulsa, Okla.

[21] Appl. No.: 708,149

[22] Filed: Aug. 23, 1996

Related U.S. Application Data

[63] Continuation-in-part of Ser. No. 230,350, Apr. 20, 1994, abandoned.

[51] Int. Cl.[6] ..... B21B 1/28

[52] U.S. Cl. ..... 72/11.4; 72/201; 72/365.2

[58] Field of Search ..... 72/17, 199, 201, 72/234, 365.2, 366.2, 205, 11.4, 12.3

[56] References Cited

U.S. PATENT DOCUMENTS

| | | | |
|---|---|---|---|
| 838,781 | 12/1906 | Forsberg . | |
| 1,640,147 | 8/1927 | Fedders et al. . | |
| 2,226,948 | 12/1940 | Simons | 72/205 |
| 2,371,671 | 3/1945 | Blount et al. . | |
| 2,529,689 | 11/1950 | Hess | 148/13.1 |
| 3,466,907 | 9/1969 | Landis et al. | 72/52 |
| 4,043,166 | 8/1977 | Leroy | 72/201 |
| 4,233,832 | 11/1980 | Rowell | 72/91 |
| 4,276,763 | 7/1981 | Schmitz | 72/234 |
| 4,506,532 | 3/1985 | Anbe | 72/8 |
| 4,507,946 | 4/1985 | Koyama et al. | 72/17 |
| 4,955,216 | 9/1990 | Barker et al. | 72/201 |

FOREIGN PATENT DOCUMENTS

| | | |
|---|---|---|
| 0314667 | 5/1989 | European Pat. Off. . |
| 0442864 | 8/1991 | European Pat. Off. . |
| 1283328 | 6/1962 | France . |
| 2196207 | 3/1974 | France . |
| 81919 | 7/1895 | Germany . |
| 57-168716 | 10/1982 | Japan . |
| 1077671 | 3/1984 | U.S.S.R. . |
| 1077672 | 3/1984 | U.S.S.R. . |
| 1161201 | 6/1985 | U.S.S.R. . |

OTHER PUBLICATIONS

Joseph E. Bleslada, Oct. 1990, Digital adjustable–speed drives up throughput and productivity, Industrial and Process Control Magazine.

*Primary Examiner*—Lowell A. Larson
*Assistant Examiner*—Thomas C. Schoeffler
*Attorney, Agent, or Firm*—Molly D. McKay, P.C.

[57] ABSTRACT

The invention is a cold rolling process which converts rods of hot rolled metal into strips with width to thickness ratios as high as approximately 17 to 1. The process cools the rod between successive rolling mills and employs feed backward tension controls to direct the speed of each individual upline rolling mill in order to reduce the thermal and mechanical shock experienced by the rod as it is flattened into a strip.

22 Claims, 2 Drawing Sheets

PROCESS FOR MAKING A STRIP FROM A ROD

This application is a continuation-in-part of application Ser. No. 08/230,350 filed on Apr. 20, 1994, now abandoned.

BACKGROUND OF THE INVENTION

1. Field of the Invention

The present invention relates to a process for producing a rectangular strip from a hot rolled, round rod by passing the rod consecutively through a series of rolling mills. More specifically, the invention relates to a process which employs inter-cooling between consecutive rolling mills as well as strip tension control to produce a strip which exceeds currently achievable maximum width to thickness ratios.

2. Description of the Related Art

Finned tubes are employed in many commercial applications as a means to allow heat exchange to occur between mediums of different temperatures without necessitating commingling of the mediums. One common design for finned tubes employs a fin constructed of a continuous strip of metal fin material. In cross section, this strip is rectangular in dimension, having a width exceeding its thickness. To form the finned tube, the strip is helically wound around the exterior surface of a hollow tube and secured thereto so that one of the shorter sides of the cross-sectional rectangular shaped strip is secured adjacent to the tube's exterior surface and the width of the strip extends outward away from and perpendicular to the tube's exterior surface.

For optimum performance of the finned tube, it is desirable to employ strips having a width to thickness ratio (calculated by dividing the width by the thickness) of approximately 17 to 1. For example, one common strip size has a width of 0.80 inches and a thickness of 0.047 inches resulting in a width to thickness ratio of approximately 17.2 to 1.

The current method for producing strips of the desired dimensions is to begin with a sheet of continuous cold rolled metal, often carbon steel, of the desired thickness. The sheet is then slit into strips of the desired width. During manufacture of the cold rolled sheets, the sheets are uniformly rolled to close tolerances. The price of these sheets reflects the time and effort required to roll them to close tolerances. When the cost of slitting the sheets is added to the cost of the sheets, the total cost to produce strips according to current methods is quite expensive.

The cost for producing strips could be reduced considerably if the strips could be made from less expensive hot rolled rod instead of from the cold rolled sheets. Current methods for converting a hot rolled rod into a strip generally consists of passing a rod consecutively through a series of rolling mills. Each rolling mill further flattens and widens the rod until the desired strip dimension is achieved. However, certain dimensional limitations are encountered when employing currently known methods for converting rods into strips.

Specifically, current methods for converting a rod into a strip are limited to creation of strips with width to thickness ratios of less than approximately 12 to 1. When current methods are employed to create strips having width to thickness ratios exceeding approximately 12 to 1, for example having ratios of 15 to 1 or 17 to 1, during the rolling process the metal strip develops severe edge fractures. These fractures cause the strip to break. The cause these fractures appear to be two-fold. First, as the metal rod is passed through each consecutive rolling mill, heat is added to the metal until the metal finally reaches a temperature at which it fails, causing it to fracture or break. Second, in addition to the heat stress exerted on the metal, mechanical stress is inflicted on the metal by the tug on the rod from the subsequent rolling mill as it pulls the rod toward the mill. This mechanical stress seems to contribute to the metal failure which is observed. Regardless of the cause of the failures, until now the practical upper limit for rolling rod into strips has been the 12 to 1 width to thickness ratio. Because strips having higher width to thickness ratios than 12 to 1 are necessary for construction of finned tubes, production of strips for this use from hot rolled rod has not until now been a viable option.

The present invention addresses this problem of limited width to thickness ratio by providing a method for producing strips from rods which utilizes cooling and feed backward tension controls between adjacent rolling mills in order to produce strips having width to thickness ratios of up to approximately 17 to 1.

SUMMARY OF THE INVENTION

The present invention is a process for creating strips from hot rolled metal rods such that the strip which is produced achieves a width to thickness ratio of approximately 17 to 1. The process consists of cooling the rod after it passes through each consecutive rolling mill to reduce the thermal stress on the rod and employs feed backward tension controllers following each consecutive rolling mill in order to control the previous rolling mill and thereby reduce the mechanical stress on the rod. Cooling is preferably accomplished by immersing the rod in a liquid cooling bath and/or by spraying cooling fluid directly on the rod.

DETAILED DESCRIPTION OF THE PREFERRED EMBODIMENT

Figure 1:
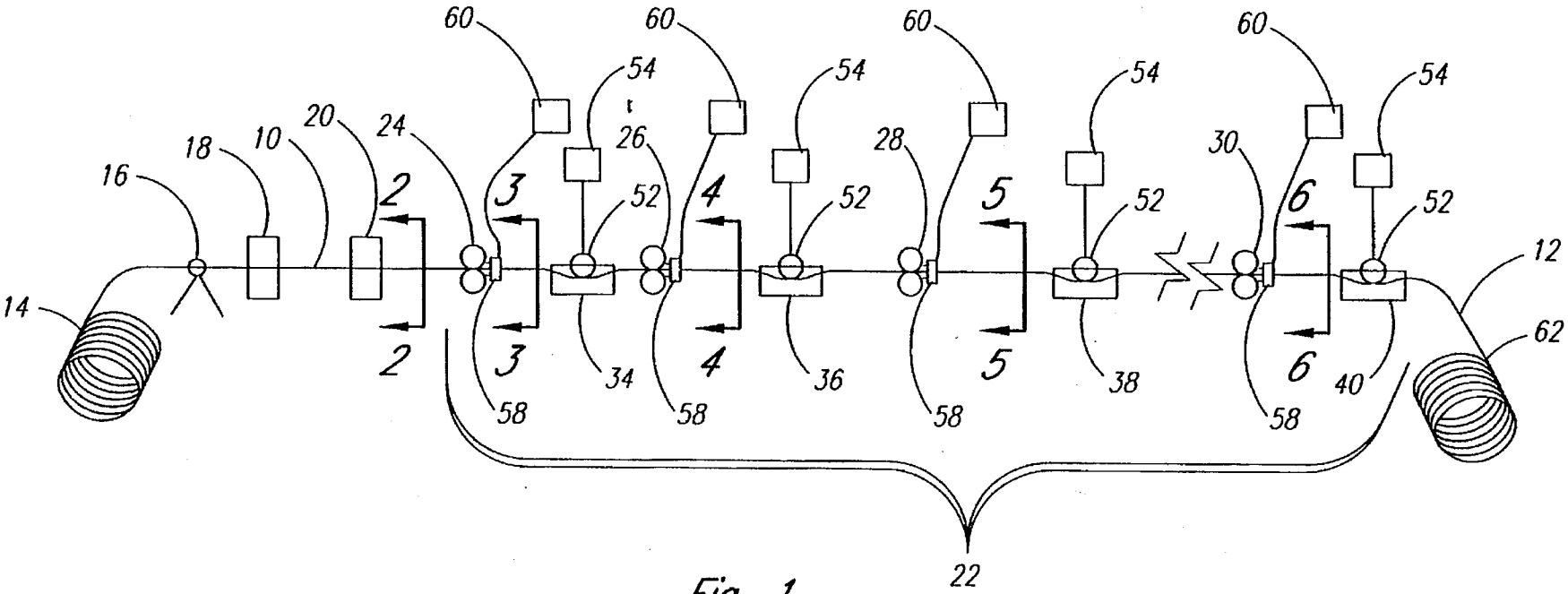
FIG. 1 is a diagrammatic representation showing the process of the present invention, starting on the left-hand side with a spool of hot rolled rod and ending on the right-hand side with a strip which is rewound into a spool and ready for use or for further processing.
Figure 6:
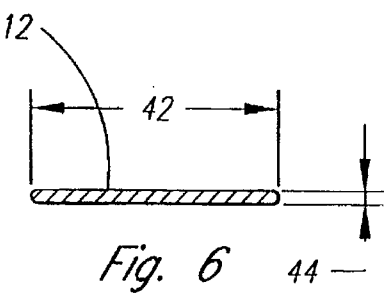
FIG. 6 is a cross-sectional view of the strip which was created by flattening the rod, taken along line 6—6 of FIG. 1.
Figure 5:
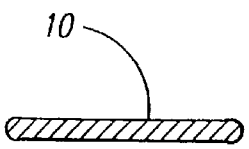
FIG. 5 is a cross-sectional view of the still further flattened rod, taken along line 5—5 of FIG. 1.
Figure 4:
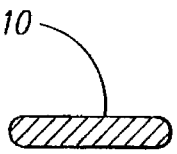
FIG. 4 is s cross-sectional view of the further flattened rod, taken along line 4—4 of FIG. 1.
Figure 3:
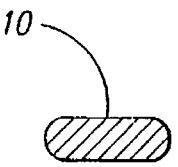
FIG. 3 is a cross-sectional view of the partially flattened rod, taken along line 3—3 of FIG. 1.
Figure 2:
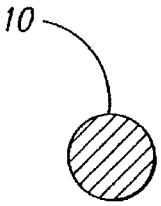
FIG. 2 is a cross-sectional view of the rod taken along line 2—2 of FIG. 1.

Referring now to the drawings and initially to FIG. 1, there is diagrammatically illustrated a process according to a preferred embodiment of the present invention for converting a rod 10, such as a hot rolled rod of carbon steel, into a strip 12 suitable for use as a fin for a finned tube (not illustrated) or for other commercial applications. Beginning on the left-hand side of FIG. 1 and moving toward the right-hand side, there is illustrated a spool 14 of rolled up rod 10 which is next unwound through an eye 16. The purpose of the eye 16 is to prevent the rod 10 from becoming tangled or kinked as it unwinds from the spool 14. Next, the rod 10 enters a descaler 18 which removes any scale or oxidation product present on the surface of the rod 10. After being descaled, the rod 10 enters a straightener 20 which straightens the rod 10 in preparation for entering a rolling train portion 22 of the process. The rolling train portion 22 consists of a plurality of rolling mills 24, 26, 28, 30, etc. arranged in series, with each individual rolling mill 24, 26, 28, or 30, being followed by its respective liquid cooling bath 34, 36, 38 or 40. This arrangement is best illustrated in FIG. 1 where the first rolling mill 24 is followed consecutively by the first liquid cooling bath 34, the second rolling mill 26, the second liquid cooling bath 36, the third rolling mill 28, the third liquid cooling bath 38, etc. until the rolling train portion 22 ends with the final rolling mill 30 followed by the final liquid cooling bath 40.

Figure 7:
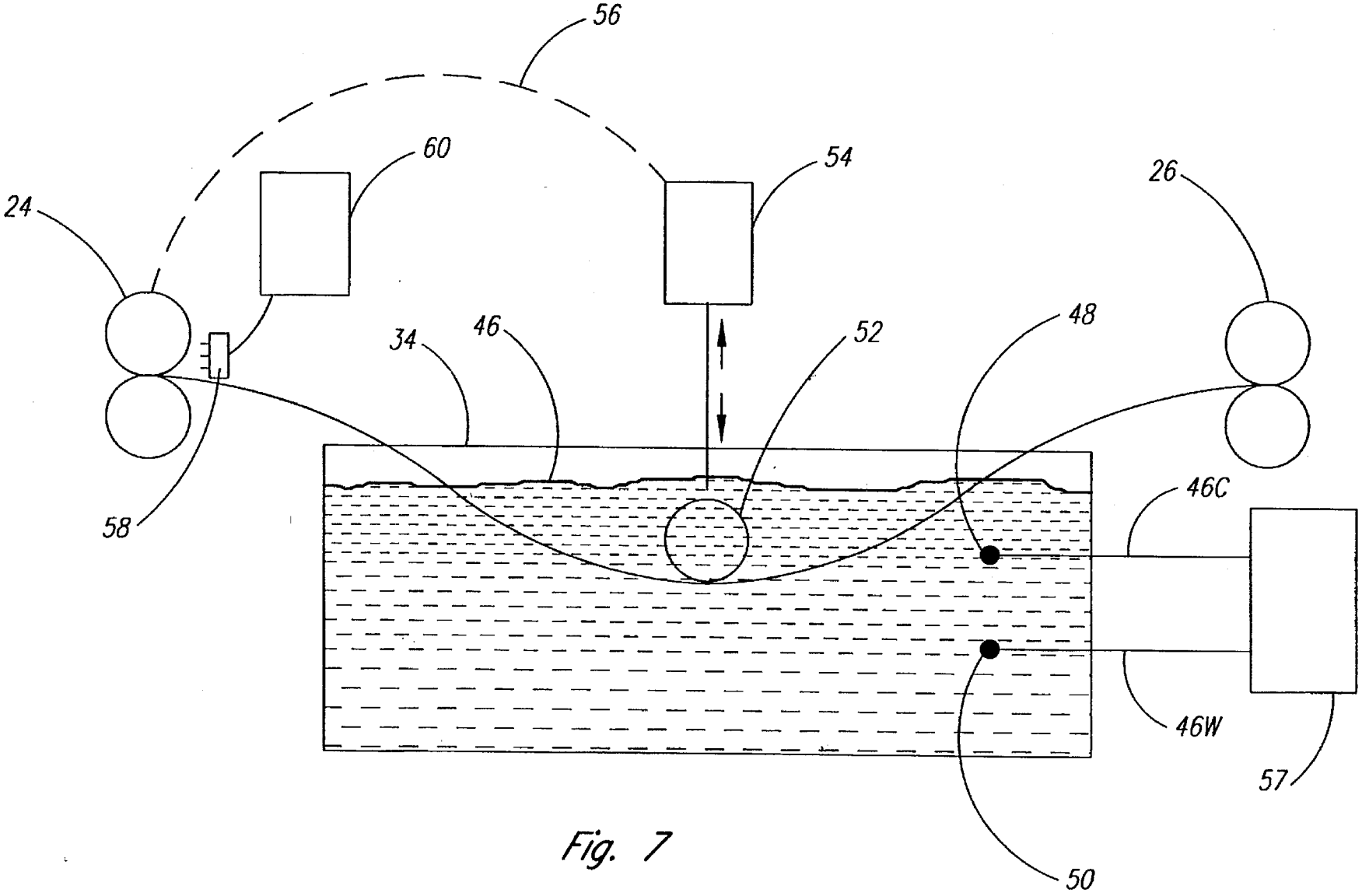
FIG. 7 is an enlarged view of one of the liquid cooling baths and feed forward tension controllers depicted in FIG. 1.

As illustrated in FIGS. 2 through 6, as the rod 10 progresses through the rolling train portion 22, it is progressively flattened and widened, resulting in conversion of the rod 10 to the strip 12 as it exits the rolling train portion 22. The strip 12 has a width 42 and a thickness 44 measured perpendicular to its width 42. Referring now to FIG. 7, there is shown in enlarged detail a preferred arrangement of the first liquid cooling bath 34. Although the first liquid cooling bath 34 is illustrated and discussed, the remaining liquid cooling baths 36, 38, 40, etc. are similarly arranged. The first liquid cooling bath 34 is filled with a cooling fluid 46, such as water, which enters the first liquid cooling bath 34 via an inlet 48 and exits the first liquid cooling bath 34 via an outlet 50 as will be further explained hereafter.

As illustrated in FIG. 7, the rod 10 exits from the first rolling mill 24 upstream of the first liquid cooling bath 34. The rod 10 then enters the first liquid cooling bath 34 where the rod 10 is cooled by direct contact with the cooling fluid 46. The rod 10 is immersed in the cooling fluid as the rod 10 passes under a roller 52 provided on a feed forward tension controller 54 before reemerging from the first liquid cooling bath 34 in order to travel through the second rolling mill 26.

Although the process is described with cooling of the rod 10 being provided between each adjacent rolling mill 24, 26, 28, and 30, it is anticipated that adequate cooling of the rod 10 may be accomplished with fewer cooling baths 34, 36, 38, and 40, fewer cooling nozzles 58, or fewer other alternate cooling means (not illustrated).

The roller 52 is in rolling contact with the rod 10 which passes under the roller 52 as the rod 10 travels through the first liquid cooling bath 34. The roller 52 responds to increases in tension in the rod 10 by moving upwardly and responds to decreases in tension in the rod 10 by moving downwardly. This upward and downward movement is illustrated by the arrows shown in FIG. 7. This upward and downward movement is translated into an electronic signal which controls the drive speed of the preceding first rolling mill 24, as is illustrated in FIG. 7 schematically by a broken line 56 which connects the feed backward tension controller 54 and the first rolling mill 24. By controlling the speed of the preceding first rolling mill 24, mechanical stress is decreased on the rod 10 as the rod 10 exits the first rolling mill 24.

In order to maintain the cooling fluid 46 contained within the first liquid cooling bath 34 at an acceptable temperature, i.e., at a temperature below the boiling point of the cooling fluid 46, warm cooling fluid 46-W is continuously removed via the outlet 50, cooled by passing it through a conventional heat exchange process 57, and then recirculating cool cooling fluid 46-C back to the first liquid cooling bath 34 via the inlet 48.

As illustrated in FIGS. 1 and 7, cooling nozzles 58 are optionally provided at each of the rolling mills 24, 26, 28, and 30. The purpose for these cooling nozzles 58 is to provide additional cooling in the form of cooling fluid 46 which is supplied from a cooling fluid source 60. The cooling fluid 46 enters the cooling nozzles 58 from the cooling fluid source 60 and is emitted from the cooling nozzles 58, impinging directly on the heated rod 10 as the rod 10 passes through each of the rolling mills 24, 26, 28, and 30.

Alternately, the cooling nozzles 58 may be used solely to provide the necessary cooling of the rod 10, thereby eliminating the need for cooling baths 34–40. Although the cooling nozzles 58 and the cooling baths 34–40 have been described for use with cooling fluid 46, other coolants, not illustrated, such as liquids or gases may be substituted for the cooling fluid, and other alternate cooling means, not illustrated, may be employed instead of either cooling nozzles 58 or cooling baths 34–40.

Once the strip 12 is produced, the strip 12 is rewound into a spool 62, as illustrated in FIG. 1. The spool 62 of strip 12 is then ready for use or for further processing.

Examples of results achieved:

The following data illustrates the results which have been successfully attained employing this process.

EXAMPLE 1

Rod Diameter: 7/16"
Number and Size of Rolling Mills: 4 10" Diameter Rolls
Width of Strip: 0.80"
Thickness of Strip: 0.048"
Width/Thickness Ratio: 17:1

EXAMPLE 2

Rod Diameter: ½"
Number of Rolling Mills: 56 ½" Diameter Rolls
Width of Strip: 0.80"
Thickness of Strip: 0.048"
Width/Thickness Ratio: 17:1

Although this process has been described in terms of producing carbon steel strips to be used in producing finned tubes, the process is not so limited and may be employed to produce strips of different metal compositions or strips for use in different functional applications.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

Further Description

The present invention is a cold rolling process which employs cold processing rolling mills 24, 26, 28 and 30 in making the strip 12 from the rod 10. As shown in FIG. 1, the rod 10, which has previously been wound onto spool 14, is cold feedstock material. The term "hot rolled rod", as used in this document refers to the process or method by which this feedstock material was originally formed in a separate hot rolling process. Cold rod, such as the rod 10 employed in this invention, typically must be unwound from a spool through an eye in order to prevent the rod from becoming tangled or kinked. Also, cold rod normally requires descaling before it is subsequently used. Such an arrangement is illustrated in FIG. 1, with the rod 10 being unwound from spool 14 through eye 16, and being descaled via descaler 18 before it enters the cold rolling train which comprises the present invention.

Although the present invention is a cold rolling process, and therefore, the process does not intentionally add heat to the rod 10, heat is incidentally introduced into the rod 10 via the rolling mills 24, 26, 28 and 30 because of the high horsepower rollers and motors necessary to roll the large diameter steel rod 10 into the flat strip 12 and the resulting molecular friction created within the rod 10 as it is being rolled. If this heat is not removed from the rod 10 as it is rolled, the rod 10 will become so structurally weak that it will break. The purpose for cooling the rod 10 in the present invention is for the sole purpose of preventing such a physical failure in the rod 10. Once the strip 12 is formed via the present invention, the strip 12 is further processed via additional known processes by heating the strip 12 in an annealing furnace in order to achieve desired metallurgical properties, i.e., tensile strength, elongation and ductility, in the strip 12. Such subsequent heating processes are not a part of the present invention.

Cold rolling processes and hot rolling processes differ markedly in two respects. First, in hot rolling processes, the material being rolled needs to be hot as it is rolled. To achieve this goal, heaters are often employed to intentionally add heat to the material so the material is almost in a semi-fluid condition. Cold rolling processes, on the other hand, must keep the material being rolled below the temperature achieved in hot rolling processes so that the material does not become so hot internally that it loses its internal structure and breaks.

Second, the purposes behind cooling are different in hot rolling processes and cold rolling processes. As previously stated, the purpose for cooling the material which is being rolled in a cold rolling process is to prevent the material from becoming so hot that it self destructs by internal structure failure. Hot rolling processes use cooling for totally different purposes. For example, hot rolling processes use cooling in order to solidify molten metal to obtain cast metal, hot form cast metal, and pickle or cool the hot formed cast metal in a pickling or quenching apparatus. Hot rolling processes employ cooling to achieve desired physical and metallurgical properties. Such physical and metallurgical properties may include, for example, tensile strength, elongation, ductility and electric conductivity. These properties vary as a function of the cooling rate of the metal during the hot rolling process.

The present invention controls tension in the rod 10 in order to minimize tension on the rod 10 before it enters the rolling process, as it passes between adjacent rolling mills 24, 26, 28 and 30, and after it emerges from the rolling process as the strip 12. The goal of the present invention is to minimize this tension so that the tension approaches as close as possible to "0" or no tension anywhere on the rod 10 or the strip 12. The sole purpose for minimizing tension in the present invention is to minimize mechanical stress on the rod 10 and strip 12 in order that they not be torn apart in the rolling process.

This differs from other rolling processes which generally require the exertion of tension on the material being rolled, sometimes significant amounts of tension, in order to control width of the final rolled product, eliminate irregular contour of the product, prevent weakening of the material, eliminate distorted curved lines, prevent crowning, or eliminate uneven, wavy or rough edges.

Minimization of tension, as employed in the present invention, differs from minimization of deviation in interstand tension. Minimizing deviation in interstand tension simply is applying constant tension throughout the rolling process in order to prevent slippage between rollers and looping of excess material between adjacent rolling mills, whereas, minimizing tension seeks to eliminate all tension on the material.

Finally, the present invention focuses on rolling the rod 10 which has a large beginning diameter. In fact, the present invention has been successfully demonstrated on rod diameters of up to ½ inch, while achieving width to thickness ratios of 17 to 1. Although there may be an upper limit to the rod diameter usable with the present method, that upper limit probably exceeds approximately ⅝ inch initial rod diameter, while still being able to obtain a width to thickness ratio of approximately 18 to 1.

What is claimed is:

1. A cold rolling process for creating a strip from a rod comprising passing a rod through a series of cold processing rolling mills, cooling the rod as the rod passes between consecutive rolling mills and minimizing tension on the rod as the rod passes between consecutive rolling mills.

2. A process according to claim 1 wherein the cooling of the rod is accomplished by immersing the rod in a cooling fluid.

3. A process according to claim 2 wherein the cooling fluid employed is water.

4. A process according to claim 2 wherein the cooling of the rod is further accomplished by spraying cooling fluid onto the rod.

5. A process according to claim 4 wherein the cooling fluid employed is water.

6. A process according to claim 1 wherein the cooling of the rod is accomplished by spraying cooling fluid onto the rod.

7. A process according to claim 6 wherein the cooling fluid employed is water.

8. A process according to claim 1 further comprising monitoring tension in the rod immediately downstream of each rolling mill with a tension controller and employing the tension controllers to control speed of an adjacent rolling mill.

9. A cold rolling process for creating a strip from a steel rod comprising passing a steel rod through a series of cold processing rolling mills, cooling the rod as the rod passes between consecutive rolling mills and minimizing tension on the rod as the rod passes between consecutive rolling mills.

10. A process according to claim 9 wherein the cooling of the rod is accomplished by immersing the rod in a cooling fluid.

11. A process according to claim 10 wherein the cooling fluid employed is water.

12. A process according to claim 10 wherein the cooling of the rod is further accomplished by spraying cooling fluid onto the rod.

13. A process according to claim 12 wherein the cooling fluid employed is water.

14. A process according to claim 9 wherein the cooling of the rod is accomplished by spraying cooling fluid onto the rod.

15. A process according to claim 14 wherein the cooling fluid employed is water.

16. A process according to claim 9 further comprising monitoring tension in the rod immediately downstream of each rolling mill with a feed backward tension controller and employing the feed backward tension controllers to control speed of an adjacent upstream rolling mill.

17. A cold rolling process for creating a strip from a steel rod comprising the following steps:

1. cleaning and straightening a steel rod,
2. passing the rod through a rolling mill,
3. cooling the rod and minimizing tension on the rod,
4. repeating steps 2 and 3 until a strip of the desired dimensions is produced.

18. A process according to claim 17 wherein the cooling of step 3 is accomplished by immersing the rod in a cooling bath filled with cooling fluid.

19. A process according to claim 18 wherein the cooling bath is filled with water.

20. A process according to claim 17 wherein speed of each of the rolling mills is controlled by a feed backward tension controller which continuously monitors tension of the rod.

21. A process according to claim 20 wherein the cooling of step 3 is further accomplished by spraying cooling fluid onto the rod from spray heads located at each rolling mill.

22. A process according to claim 21 wherein the cooling fluid is water.

* * * * *